US005521343A

United States Patent [19]

Young et al.

[11] Patent Number: 5,521,343

[45] Date of Patent: May 28, 1996

[54] PLASTIC IGNITION HIGH VOLTAGE SWITCH HOUSING

[75] Inventors: Robert E. Young; Kenneth W. Clark; Perry J. Washington; David J. Kelly; David B. Bridges, all of Anderson, Ind.

[73] Assignee: General Motors Corporation, Detroit, Mich.

[21] Appl. No.: 197,907

[22] Filed: Feb. 17, 1994

[51] Int. Cl.[6] ..... F02P 1/00; H01H 9/00; H01H 19/00

[52] U.S. Cl. ..... 200/19 R; 123/146.5 A

[58] Field of Search ..... 200/19 R, 19 M, 200/19 DR, 19 DC; 123/146.5 R, 146.5 A; 464/87–99, 170, 178

[56] References Cited

U.S. PATENT DOCUMENTS

| | | | |
|---|---|---|---|
| 3,678,224 | 7/1972 | Takeda | 200/19 M |
| 3,921,225 | 11/1975 | Suska | 16/136 |
| 4,225,759 | 9/1980 | Fox et al. | 200/19 M |
| 4,282,836 | 8/1981 | Fox et al. | 123/146.5 A |
| 4,295,014 | 10/1981 | Fox et al. | 200/19 R |
| 4,470,385 | 9/1984 | Burk et al. | 123/146.5 B |

*Primary Examiner*—J. R. Scott
*Attorney, Agent, or Firm*—Timothy G. Gorbatoff

[57] ABSTRACT

A plastic ignition high voltage switch housing comprising two separately molded components formed of a high temperature, high strength insulating thermoplastic material, each component containing one bushing. The two components are spun welded together while maintaining axial alignment of the bushings. The two components can be designed to permit the placement of a gasket between them prior to spin welding, thereby capturing the gasket within the housing.

3 Claims, 2 Drawing Sheets

PLASTIC IGNITION HIGH VOLTAGE SWITCH HOUSING

This invention relates to an ignition high voltage switch housing for an internal combustion engine, and more particularly to an ignition high voltage switch housing composed of plastic, and a method of making the same.

BACKGROUND OF THE INVENTION

Ignition high voltage switches (distributors) for internal combustion engines comprise a housing having a central bore which receives a shaft journaled for rotation in bushings axially aligned and supported within the bore. The housing has a stem portion for insertion into the engine and a base portion for supporting a cap. Installation of a completely assembled high voltage switch in the engine requires positioning of a gasket over the stem prior to insertion. The gasket provides a seal between the engine and base.

Prior art housings are composed of metallic material, most often aluminum. The benefits of using a plastic rather than a metal are threefold. First, no machining is required after the initial molding of a plastic part. Plastics can be injection molded into a final form. Metal castings often require subsequent machining, increasing the labor and tooling costs of producing the part. A metal ignition high voltage switch housing requires several additional manufacturing operations; in particular, machining the central bore for receiving the shaft, machining the outside diameter of the shaft for insertion into an engine bore and press-fitting bushings into the extreme ends of the central bore.

Second, plastics are much lighter than metals, reducing the total vehicle weight and improving fuel economy. Third, plastics are much less expensive than their metallic counterparts, reducing the material costs of producing the engine.

Ignition high voltage switch housings have continued to be manufactured from metals due to the high thermal temperatures and mechanical stresses to which they are subjected within the engine. High temperature, high strength insulating thermoplastics capable of withstanding these temperatures and stresses are available. Unfortunately, existing plastic injection molding technology has not been able to form a suitable housing. Several technological problems continue to exist. Particularly, molding of the long housing results in unacceptable warpage, making alignment of the two bushings located at extreme ends of the housing extremely difficult, as well as, control over the external dimensions of the stem necessary to fit properly within the engine bore.

SUMMARY OF THE INVENTION

The present invention is directed to a plastic ignition high voltage switch housing comprising two separately molded components, a base and stem. Each component is formed of a high temperature, high strength insulating thermoplastic injection molded around a single bushing. By forming smaller components, exacting control over warpage is much easier. The components are then spun welded together by a method which maintains proper axial alignment of the bushings. The plastic housing is light weight, inexpensive and requires no subsequent machining operations.

In order to eliminate the additional assembly plant manpower required to position a gasket over the housing stem prior to insertion into the engine, the base and stem can be designed to permit placement of a gasket between the two components prior to the spin welding process, thereby capturing the gasket between them. By making the gasket integral with the housing, the need for adding a gasket during assembly is eliminated.

DETAILED DESCRIPTION OF THE DRAWINGS

Figure 1:
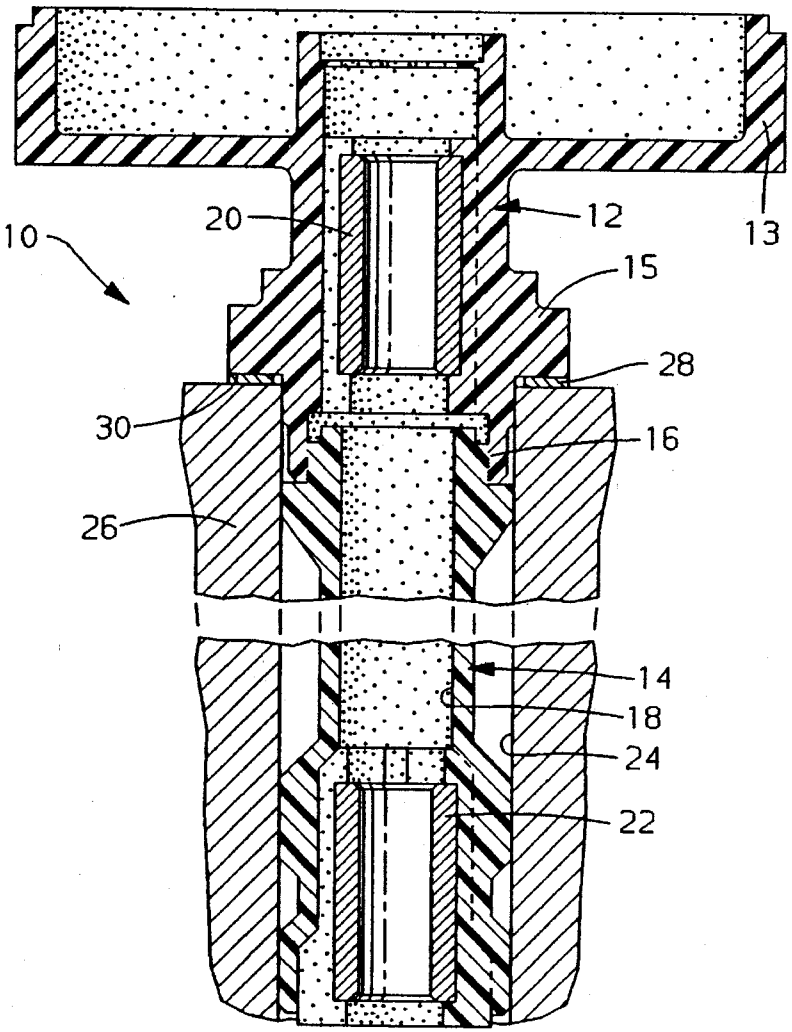
FIG. 1 illustrates an assembled plastic high voltage switch housing in accordance with this invention.

Referring now to the drawings, and more particularly to FIG. 1, the reference numeral 10 generally designates the housing of an ignition high voltage switch composed of high temperature, high strength, insulating thermoplastic material (e.g., ULTEM 2300 manufactured by General Electric). The housing 10 is comprised of two separate components, a base 12 and stem 14, which are individually injection molded around one of bushings 20 and 22, respectively.

The base 12 has an annular portion 13 which supports a cap (not shown). The base 12 further has a cylindrical portion 15 which is spin welded together with stem 14 at interface 16 to form a completed housing 10.

Spin welding is a known process of permanently joining two plastic parts in which one of the parts is securely fastened while the other is rotated at a high speed. The two parts are forced together and heat which develops from the friction melts the plastic at the contacting surfaces. When the rotation is stopped, the two melted surfaces solidify together, fusing the parts permanently.

Assembly of a completed housing 10 to the engine 26 requires insertion of the stem 14 into a bore 24, the housing 10 being secured to the engine 26 by a suitable clamping means known to those skilled in the art. Annular gasket 28 acts as a seal between the engine 26 and base surface 30.

The housing 10 has a central aperture 18 which receives a shaft (not shown) journaled for rotation in bushings 20 and 22 which are supported within extreme ends of the central aperture 18.

Figure 2:
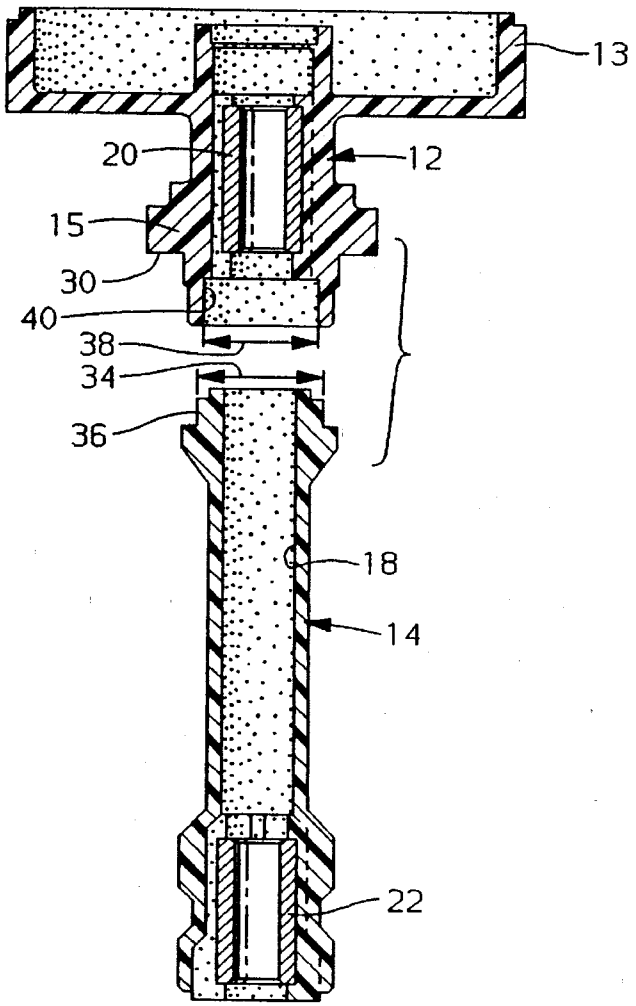
FIG. 2 illustrates separately the components comprising the plastic housing.

Referring to FIG. 2, the housing components 12 and 14 are illustrated separately. One end of stem 14 is formed to have an outside diameter 34 defined by surface 36 which is slightly larger than an inside diameter 38 of an aperture defined by surface 40 on an opposing end of the base 12.

The base 12 and stem 14 are spin welded together which permanently joins surfaces 36 and 40. For proper assembly and operation of the high voltage switch, it is critical that the bushings 20 and 22 be axially aligned in the completed housing 10.

Figure 3:
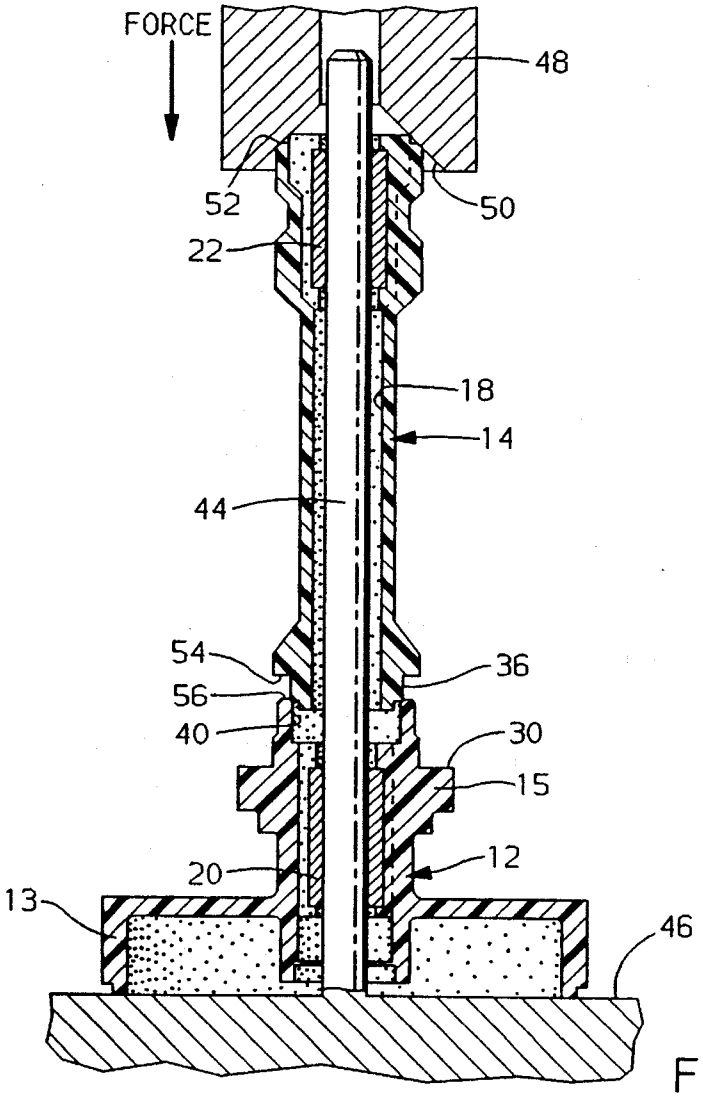
FIG. 3 illustrates the spin welding method in accordance with this invention.

FIG. 3 illustrates the method of spin welding the base 12 and stem 14 together while maintaining proper axial alignment of the bushings 20 and 22.

The base 12 is placed over an arbor 44, journaled for an exacting fit inside bushing 20. The base 12 is secured to a platform surface 46, preventing any rotation. The stem 14 is then placed over the arbor 44 until it seats against the base 12, there being an exacting fit between the bushing 22 and arbor 44. The stem 14 is not secured and is able to spin freely.

Because the outside diameter 34 of the stem 14, defined by surface 36, is slightly larger than the inside diameter 38 of the base 12, defined by surface 40, the base 12 and stem 14 will remain positioned as illustrated.

A driver 48 is placed over the arbor 44 and is driven at a high rotational speed (approx. 3400 rpm). A downward force is applied to the driver 48 causing driver surface 50 to contact the stem 14 at interface 52. A downward force is applied to the driver 48 sufficient to engage the stem 14 and rotate it at the rotational speed of the driver 48.

Heat which develops from the friction between rotating surface 36 and stationary surface 40 in contact with one another is sufficient to melt the mating surfaces 36 and 40. As the plastic contacting surfaces 36 and 40 melt, the stem 14 begins to travel downward in response to the driver 48 force until stem surface 54 seats against base surface 56, completing the engagement of the two components 12 and 14. Once the engagement is complete, rotation of the stem 14 is stopped and the driver 48 is removed. The melted surfaces 36 and 40 are then permitted to solidify together, fusing the base 12 and stem 14 together permanently. A completed housing 10 was previously illustrated in FIG. 1. At an rpm of 3400, only 1½ rotations of the stem 14 are required for complete engagement with the base 12.

Figure 4:
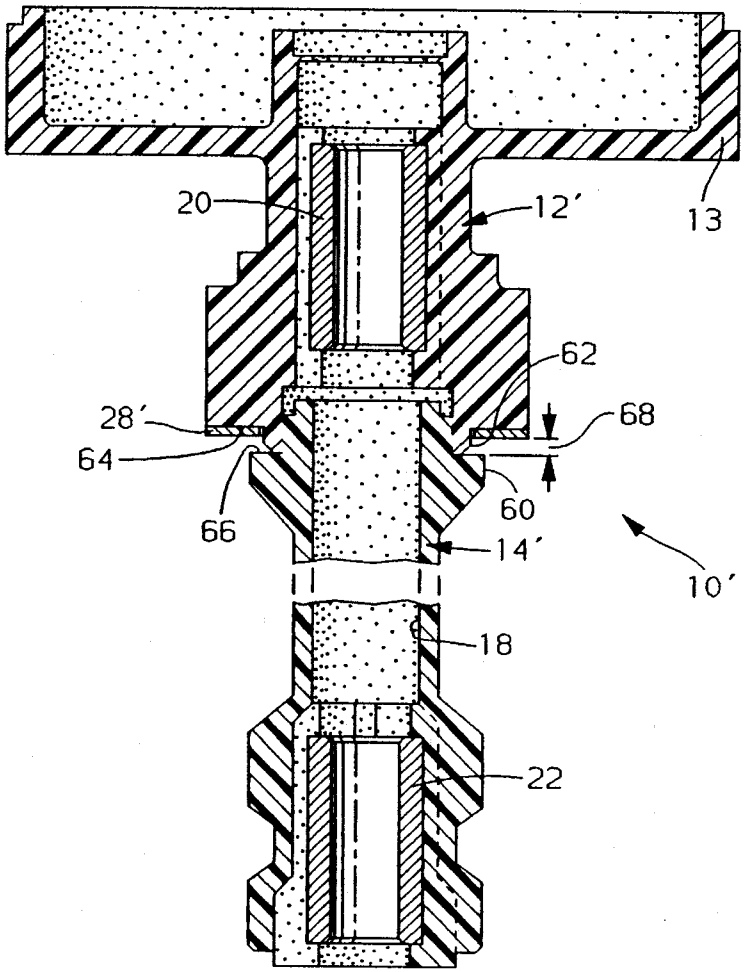
FIG. 4 illustrates an alternative embodiment of the plastic housing having an integral gasket.

Referring back to FIG. 1, gasket 28 is placed over the stem 14 prior to assembly of the housing 10 into the engine 26. FIG. 4 illustrates an alternative embodiment which incorporates gasket 28' as an integral part of the housing 10'. This is accomplished by modifying the design of the base 12' and stem 14'. Referring to FIG. 4, the inside diameter of gasket 28' is slightly larger than the cylindrical base surface 62. This permits the placement of the annular gasket 28' over the base surface 62 prior to seating the stem 14' against the base 12' before spin welding the components together.

The outside diameter of stem surface 60 is larger than the inside diameter of gasket 28', capturing the gasket 28' between base surface 64 and stem surface 66 after engagement of the two housing components 12' and 14'. The gasket 28' can rotate freely because the dimension 68 between surfaces 64 and 66 is greater than the thickness of the gasket 28'.

While the present invention has been described in reference to the illustrated embodiments, it will be recognized that various modifications will occur to those skilled in the art. In this regard, it will be understood that ignition high voltage switch housings and methods of making such housings incorporating such modifications may fall within the scope of this invention, which is defined by the appended claims.

The embodiments of this invention in which an exclusive property or privilege is claimed are defined as follows:

1. An ignition high voltage switch housing for an internal combustion engine comprising:

a base formed of a plastic and having a first central aperture within which is secured a first bushing, the first bushing being axially aligned within the first central aperture; and a stem formed of a plastic and having a second central aperture within which is secured a second bushing, the second bushing being axially aligned within the second central aperture, the stem being affixed to the base by spin welding such that the first and second bushings are axially aligned.

2. The ignition high voltage switch housing according to claim 1, the housing further comprising a gasket captured, and freely rotatable, between the base and stem, the gasket acting as a seal between the high voltage switch housing and engine.

3. The ignition high voltage switch housing according to claim 1, wherein the base and stem are injection molded around their respective bushings, thereby securing the first and second bushings within the first and second central apertures, respectively.

* * * * *